US007264030B2

(12) United States Patent
Boyarski

(10) Patent No.: US 7,264,030 B2
(45) Date of Patent: Sep. 4, 2007

(54) FOLDING COIN PURSE AND METHOD OF MAKING THE SAME

(76) Inventor: Joseph Lee Boyarski, 6511-137 Avenue, Edmonton, Alberta (CA) T5A 0P3

( * ) Notice: Subject to any disclaimer, the term of this patent is extended or adjusted under 35 U.S.C. 154(b) by 440 days.

(21) Appl. No.: 10/761,506

(22) Filed: Jan. 21, 2004

(65) Prior Publication Data

US 2005/0155683 A1 Jul. 21, 2005

(30) Foreign Application Priority Data

Jun. 18, 2002 (CA) ..... 2389815

(51) Int. Cl.
*A45C 1/02* (2006.01)
*D05B 23/00* (2006.01)

(52) U.S. Cl. ..... 150/153; 150/135; 112/475.08

(58) Field of Classification Search ..... 150/131, 150/136, 150–153; 206/0.8, 0.84; 112/475.08; 132/286, 132
See application file for complete search history.

(56) References Cited

U.S. PATENT DOCUMENTS 539,248 A * 5/1895 Cano ..... 150/136
575,809 A * 1/1897 O'Riva ..... 281/31
637,365 A * 11/1899 Weaver ..... 150/153
774,522 A * 11/1904 Kerst et al. ..... 150/153
1,630,654 A * 5/1927 Buxton ..... 150/153
1,669,897 A * 5/1928 Buxton ..... 150/150
2,288,996 A * 7/1942 Dubilier ..... 150/150
2,368,687 A 2/1945 Stanley ..... 150/28
2,612,200 A * 9/1952 June ..... 150/136
2,810,418 A * 10/1957 Aschkenasy ..... 150/150
2,869,603 A * 1/1959 Conley ..... 150/150
2,923,338 A * 2/1960 Stember et al. ..... 150/120

FOREIGN PATENT DOCUMENTS

JP 2002-159315 4/2002

* cited by examiner

*Primary Examiner*—Sue A. Weaver
(74) *Attorney, Agent, or Firm*—Davis Bujold & Daniels, P.L.L.C.

(57) ABSTRACT

This method of making a folding coin purse involves forming a first pocket and a second pocket on a layer of rectangular material and then turning the first pocket and the second pocket inside out. This forms a body with a first inside out pocket, a second inside out pocket and a narrow peripheral border. The peripheral border is biased into an upstanding position by the turning of the first pocket and the second pocket inside out. The peripheral border frames an access opening between the first inverted pocket and the second inverted pocket. A first half of the body folds over a second half of the body to close the access opening.

3 Claims, 2 Drawing Sheets

FOLDING COIN PURSE AND METHOD OF MAKING THE SAME

FIELD OF THE INVENTION

The present invention relates to a folding coin purse, which can be accommodated in a pocket, and a method of making the same.

BACKGROUND OF THE INVENTION

U.S. Pat. No. 2,368,687 (Stanley 1945) is an example of a folding coin purse. The Stanley coin purse consists of an inner flat layer and an outer flat layer of material peripherally stitched to each other. An open access window is provided in one half of the inner flat layer, leaving a loose narrow peripheral margin. The open access window allows the user to view coins within the coin purse. The peripheral margin confines the coins. The coin purse folds in half, over the access window, to assume a closed position.

Japanese Patent application 2000357237 (Kojima 2000) similarly discloses a folding coin purse with an inner layer and an outer layer. The inner layer has two "U" shaped peripheral margins arranged in end to end relation, with a transparent material closing in the "U" shape of one half to form a transparent pocket. There is a gap between the "U" shaped peripheral margins, which facilitates the coin purse folding in half.

SUMMARY OF THE INVENTION

The present invention discloses an alternative construction for a folding coin purse with collapsible walls.

According to a first aspect of the present invention there is provided a method of making a folding coin purse. A first step involves providing a layer of pliable rectangular material having a first end peripheral edge, a second end peripheral edge, a first side peripheral edge and a second side peripheral edge. A second step involves folding the first end peripheral edge over and securing the first end peripheral edge to the first side peripheral edge and the second side peripheral edge to form a first pocket. A third step involves folding the second end peripheral edge over and securing the second end peripheral edge to the first side peripheral edge and the second side peripheral edge, to form a second pocket. A fourth step involves turning the first pocket and the second pocket inside out. This forms a body with a first inside out pocket, a second inside out pocket and a narrow peripheral border, which has been biased into an upstanding position by the turning of the first pocket and the second pocket inside out. The peripheral border frames an access opening between the first inverted pocket and the second inverted pocket. A fifth step involves folding a first half of the body over a second half of the body to close the access opening.

In the prior art, an inner layer and an outer layer were secured together about a peripheral edge. This maintained the peripheral border in a relatively flat orientation. With the folding coin purse, as described above, the peripheral border is biased into an upstanding position by the turning of the first pocket and the second pocket inside out. This results in a much fuller peripheral border, which is better adapted to confine coins. The border is so much superior to the prior art, that one-handed operation of the coin purse is made possible.

According to another aspect of the present invention there is provided an alternative method of making a folding coin purse. A first step involves providing a layer of pliable rectangular material having a first end peripheral edge, a second end peripheral edge, a first side peripheral edge and a second side peripheral edge. A second step involves curling over each of the first end peripheral edge, the second end peripheral edge, the first side peripheral edge, the second side peripheral edge. The first end peripheral edge is secured to both of the first side peripheral edge and the second side peripheral edge. The second end peripheral edge is secured to both of the first side peripheral edge and the second side peripheral edge. This forms a body with a narrow peripheral border, which frames an access opening. A third step involves folding a first half of the body over a second half of the body to close the access opening.

Although a functioning folding coin purse can be obtained by following the method described above, the folding coin purse performs even better if some additional features are added.

Even more beneficial results may be obtained by taking a further step of securing a coin confining panel across the peripheral border to form a pocket on one of the first half or the second half of the body. This coin-confining panel can take various forms. It is preferred that a mesh panel or a transparent plastic panel be used.

Even more beneficial results may be obtained by taking a further step of attaching reinforcing coin confining stiffeners to the peripheral border along the first side peripheral edge and the second side peripheral edge spaced from the fold on each of the first half and the second half of the body. The stiffeners improve the ability of the material to confine the coins, when the coin purse is in a closed position and when being moving to an open position.

Even more beneficial results may be obtained by taking a further step of attaching a first fastener to the peripheral border along the first end peripheral edge and a second fastener to the peripheral border along the second side peripheral edge. The first fastener and the second fastener engage to maintain the body in a folded condition. The fasteners can take any number of forms: such as mating tape fasteners or mating snap fasteners.

Even more beneficial results may be obtained by taking a further step of securing a "U" shaped spring along the peripheral border in one of the first half or the second half of the purse. The spring biases the peripheral border into an upright orientation.

Even more beneficial results may be obtained by taking a further step of securing elastic material in tension where the first end peripheral edge is secured to the first side peripheral edge and the second side peripheral edge and where the second end peripheral edge is secured the first side peripheral edge and the second side peripheral edge. The elastic material is an alternative way of biasing the peripheral border into an upright orientation.

BRIEF DESCRIPTION OF THE DRAWINGS

These and other features of the invention will become more apparent from the following description in which reference is made to the appended drawings, the drawings are for the purpose of illustration only and are not intended to in any way limit the scope of the invention to the particular embodiment or embodiments shown, wherein.

DETAILED DESCRIPTION OF THE PREFERRED EMBODIMENT

The preferred method of making a folding coin purse will now be described with reference to FIGS. 1 through 6.

Figure 1:
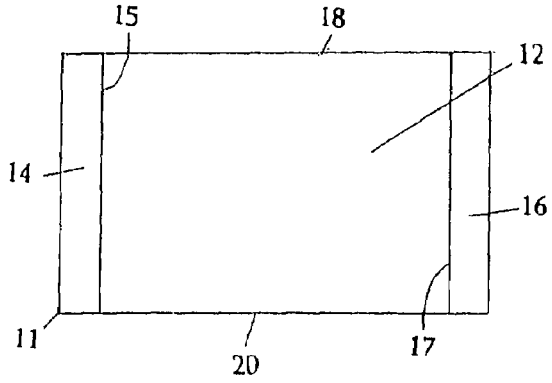
FIG. 1 is a top plan view of a layer of material showing fold lines prior to folding.
Figure 2:
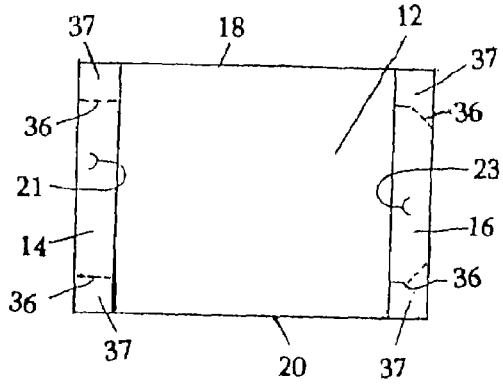
FIG. 2 is a top plan view of the layer of material illustrated in FIG. 1, with folds being made to fold over a first end peripheral edge to form a first pocket and a second end peripheral edge to form a second pocket.
Figure 3:
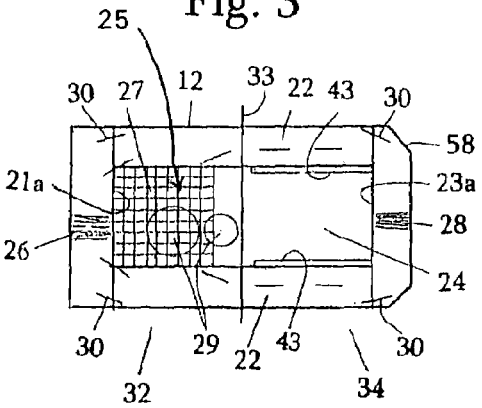
FIG. 3 is a top plan view of the layer of material illustrated in FIG. 2, with the first pocket and the second pocket turned inside out to form a narrow peripheral border along a first side edge and a second side edge.
Figure 4:
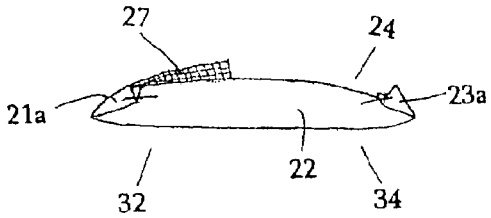
FIG. 4 is a side elevation view of the coin purse illustrated in FIG. 3, in an open orientation.
Figure 5:
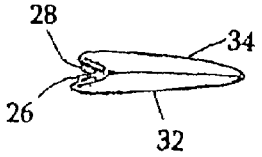
FIG. 5 is a side elevation view of the coin purse illustrated in FIG. 3, in a closed orientation.
Figure 6:
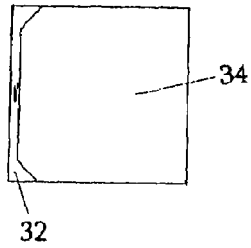
FIG. 6 is a top plan view of the coin purse illustrated in FIG. 5.

Referring to FIG. 1, there is shown a layer of pliable rectangular material 11 having a first end peripheral edge 14, a second end peripheral edge 16, a first side peripheral edge 18 and a second side peripheral edge 20. Fold lines 15 and 17 are shown. Referring to FIG. 2, first end peripheral edge 14 is folded over fold line 15 and secured to first side peripheral edge 18 and second side peripheral edge 20 to form a first pocket 21. Second end peripheral edge 16 is folded over along fold line 17 and secured to first side peripheral edge 18 and second side peripheral edge 20 to form a second pocket 23. Referring to FIG. 3, first pocket 21 and second pocket 23 are turned inside out. This forms a body 12 with a first inside out pocket 21A, a second inside out pocket 23A and a narrow peripheral border 22. Referring to FIG. 4, peripheral border 22 is biased into an upstanding position by the turning of first pocket 21 and second pocket 23 inside out. Referring to FIG. 3, peripheral border 22 frames an access opening 24 between first inside out pocket 21A and second inside out pocket 23A. Referring to FIGS. 5 and 6, a first half 32 of body 12 is folded over a second half 34 of body along a fold line 33 to close access opening 24. Referring to FIGS. 1 and 3, it is preferred that first inside out pocket 21A have a viewing window 25 covered by a substrate, such as transparent plastic or mesh 27, that confines coins 29 within first inside out pocket 21A while enabling coins 29 within first inside out pocket 21A to be viewed. It is also preferred that first half 32 of body 12 have a first fastener 26 and second half 34 of body 12 have a second fastener 28. Referring to FIG. 5, when body 12 is folded first fastener 26 and second fastener 28 are secured together to maintain body 12 in a folded condition. Body 12 may be made from various materials, such as: vinyl, vinyl lined with cloth, leather, or other cloth. There are various means which may be used to secure first end peripheral edge 14 to first side peripheral edge 18 and second side peripheral edge 20 and second end peripheral edge 16 to first side peripheral edge 18 and second side peripheral edge 20, such as by staples, sewing, rivets, glue and the like. Referring to FIG. 2, the illustrated embodiment is shown as having been secured together by sewing, as represented by seam lines 36. In order to provide a more aesthetically pleasing appearance, seams 36 at second end peripheral edge 16, seams are angled or curved. FIG. 6 illustrates the effect this has when coin purse 10 is folded into a closed position. Once turned inside out, the size of pockets 21 A and 23A together with the width of seam 37 control the size of border 22. The width of seams 37 depends upon the positioning of seam lines 36. The wider the seam, the higher the side portion of border 22 will be. It should be noted that pockets 21A and 23A need not be the same size. One of the pockets can be made larger, so as to improve coin containment or make mesh 27 redundant.

An alternative method of making a folding coin purse will now be described with reference to FIGS. 7 through 14.

Figure 7:
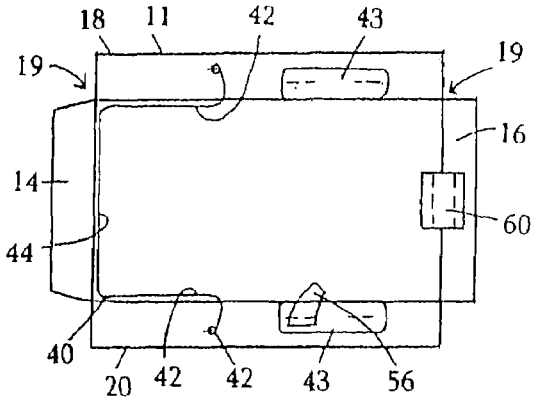
FIG. 7 is a variation of a partially constructed coin purse.

Referring to FIG. 7, a layer of pliable rectangular material 11 is provided having a first end peripheral edge 14, a second end peripheral edge 16, a first side peripheral edge 18 and a second side peripheral edge 20. It is preferred that corner portions 19 be removed prior to folding of this embodiment. Each of the first end peripheral edge 14, the second end peripheral edge 16, the first side peripheral edge 18, and the second side peripheral edge 20 are curled over. First end peripheral edge 14 is secured to both of first side peripheral edge 18 and second side peripheral edge 20. Second end peripheral edge 16 is secured to both of first side peripheral edge 18 and second side peripheral edge 20. This forms a body 12 with a narrow peripheral border 22 which frames an access opening 24. A second half 34 of body 12 folds over a first half 32 of body 12 along a fold line 33 to close access opening 24.

Figure 8:
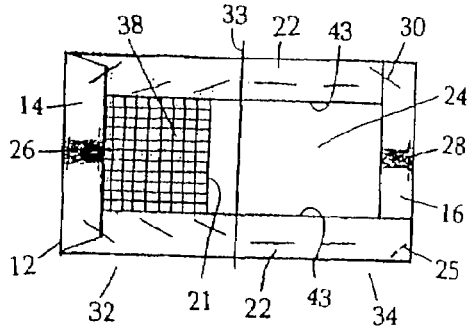
FIG. 8 is a top plan view of another variation of a coin purse.

Referring to FIG. 8, it is preferred that a coin confining panel 38 extends across peripheral border 22 to form a pocket 21 on first half 32 of body 12.

Figure 9:
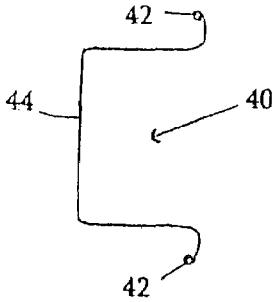
FIG. 9 is a top plan view of a spring.

Referring to FIG. 9, a "U" shaped spring 40 is provided having opposed sides 42 and a center portion 44. Referring to FIG. 7 spring 40 is positioned inside body 12. Sides 42 of the spring 40 are in contact with first side peripheral edge 18 and second side peripheral edge 20. Center part 44 of the spring 40 runs along second end peripheral edge 16 of body 12. Spring 40 biases peripheral border 22 into an upright orientation. Spring 40 allows sides 18 and 20 to be collapsed for storage when body 12 is folded, but urges peripheral border 22 to be extended into an upright orientation when body 12 is open.

Figure 10:
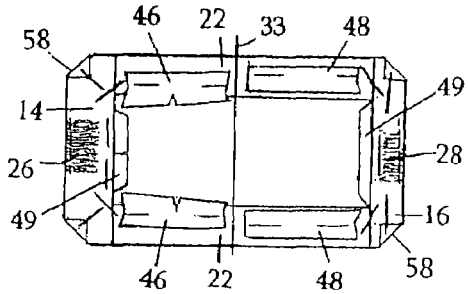
FIG. 10 is a top plan view of another variation of a coin purse.
Figure 11:
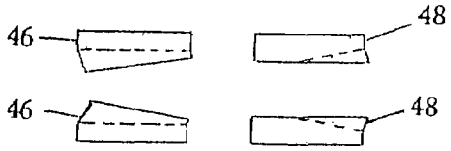
FIG. 11 a top plan view of stiffeners used in FIG. 10.
Figure 12:
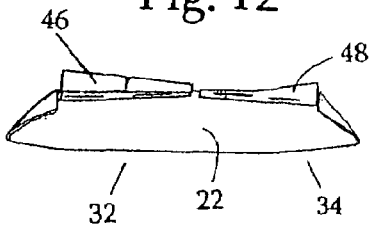
FIG. 12 is a side elevation view of the coin purse of FIG. 10.
Figure 14:
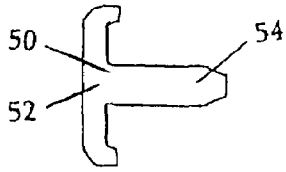
FIG. 14 is a side elevation view of a stiffener to be used in the coin purse.

Reinforcing coin confining stiffeners may be attached to peripheral border 22 along first side peripheral edge 18 and second side peripheral edge 20, spaced from fold line 33 on each of first half 32 and second half 34 of body 12. Stiffeners may be secured in different ways. Referring to FIGS. 7 and 8, stiffeners 43 may be attached to peripheral edges 18 and 20 to provide more support when the folding coin purse is constructed. Stiffeners 43 are located underneath peripheral edges 18 and 20. Referring to FIG. 10, angled plastic stiffeners 46 may be attached to the peripheral border 22 of the second half 34 of the purse 10 and stiffeners 48 attached to the peripheral border 22 of the first half 32 of the purse to form a coin barrier. Note that the stiffeners 46 and 48 are attached on top of the peripheral border 22, not underneath. Stiffeners 46 and 48 extend to near the hinge line of the purse 10 but do not cross it so as not to impede the purse 10 being folded. The plastic stiffeners 46 and 48 are shown in FIG. 11, where the dashed lines indicate angle lines along which stiffeners 46 and 48 are bent at an angle, of between 25 and 90 degrees. Stiffeners 46 are partially cut midway, so that they bend over coins. Stiffeners 46 and 48 help confine the coins in the purse 10 when the coins the purse is in the closed position and when the purse is being opened. There may also be included plastic stiffeners 49 attached underneath peripheral edges 14 and 16 to make the peripheral edges fuller, such that coins are less likely to fall out. A side view of the purse 10 is shown in FIG. 12, with the sides extended, which may be due to the type of fabric, stiffeners 49 underneath peripheral edges 14 and 16, spring 40 which lifts border 22, or a combination thereof. Referring to FIG. 14, a "T" shaped stiffener 50 is shown. This may be inserted into the second half 34 or first half 32 of the purse to provide a more rigid structure to the purse. The top 52 of the stiffener 50 is located under the top peripheral edge 14 or bottom peripheral edge 16 of the purse 10, and the bottom 54 of the stiffener 50 is matched up with the hinge line. Stiffener 50 may be anchored using stitches, glue, staples, rivets, glue; as can anything in this invention that is fastened or anchored.

Referring to FIG. 7, there is shown a key holder 60 attached to the coin purse 10 on the peripheral border 22. This may be made of an elastic type of material such as spandex. A key is held by inserting it into the holder 60, and is held by elastic properties of the holder 60.

Figure 13:
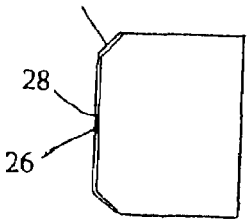
FIG. 13 is a top plan view of a variation of the coin purse of FIG. 10 in a folded position.

Referring to FIG. 10, it may also be convenient to cut or fold the corners 58 of the purse 10 such that the purse is less likely to catch on clothing when taken out of a pocket. The folded purse 10 is shown in FIG. 13.

Referring to FIG. 7, elastic material 56 may be secured in tension along first side peripheral edge 18 and second side peripheral edge 20 to bias peripheral border 22 into an upright orientation. Having peripheral border in an upright orientation with elastic material 56 enables coins to be shuffled with one hand. Elastic material 56 is used as an alternative to or to supplement spring 40.

In this patent document, the word "comprising" is used in its non-limiting sense to mean that items following the word are included, but items not specifically mentioned are not excluded. A reference to an element by the indefinite article "a" does not exclude the possibility that more than one of the element is present, unless the context clearly requires that there be one and only one of the elements.

It will be apparent to one skilled in the art that modifications may be made to the illustrated embodiment without departing from the spirit and scope of the invention as hereinafter defined in the Claims.

What is claimed is:

1. A method of making a folding coin purse, comprising the steps of:

providing a layer of pliable rectangular material having a first end peripheral edge, a second end peripheral edge, a first side peripheral edge and a second side peripheral edge;

folding the first end peripheral edge over and securing the first end peripheral edge to the first side peripheral edge and the second side peripheral edge to form a first pocket;

folding the second end peripheral edge over and securing the second end peripheral edge to the first side peripheral edge and the second side peripheral edge, to form a second pocket;

turning the first pocket and the second pocket inside out, thereby forming a body with a first inside out pocket, a second inside out pocket and a narrow peripheral border biased into an upstanding position by the turning of the first pocket and the second pocket inside out with the height of the peripheral border being determined by positioning of seams forming the first pocket and the second pocket, the peripheral border framing an access opening between the first inverted pocket and the second inverted pocket; and folding a first half of the body over a second half of the body along a fold line to close the access opening.

2. The method as defined in claim 1, the first pocket having a viewing window covered by a substrate that confines coins within the first pocket while enabling the contents of the first pocket to be viewed.

3. A folding coin purse comprising:

a body made from a layer of pliable rectangular material having a first end peripheral edge, a second end peripheral edge, a first side peripheral edge and a second side peripheral edge, the first end peripheral edge being folded over and secured to the first side peripheral edge and the second side peripheral edge to form a first pocket, the second end peripheral edge being folded over and secured to the first side peripheral edge and the second side peripheral edge, to form a second pocket;

the first pocket and the second pocket being turned inside out to form a narrow peripheral border biased into an upstanding position by the turning of the first pocket and the second pocket inside out with the height of the peripheral border being determined by positioning of seams forming the first pocket and the second pocket, the peripheral border framing an access opening between the first inverted pocket and the second inverted pocket; and a first half of the body being folded over a second half of the body along a fold line to close the access opening.

* * * * *